US007682779B2

(12) United States Patent
Ishizuka

(10) Patent No.: US 7,682,779 B2
(45) Date of Patent: Mar. 23, 2010

(54) METHOD FOR MANUFACTURING LIQUID DISCHARGE HEAD

(75) Inventor: Kazunari Ishizuka, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 65 days.

(21) Appl. No.: 12/120,858

(22) Filed: May 15, 2008

(65) Prior Publication Data

US 2008/0299497 A1 Dec. 4, 2008

(30) Foreign Application Priority Data

May 28, 2007 (JP) ..... 2007-140303

(51) Int. Cl.
*B41J 2/16* (2006.01)

(52) U.S. Cl. ..... 430/320; 347/47

(58) Field of Classification Search ..... None
See application file for complete search history.

(56) References Cited

U.S. PATENT DOCUMENTS 5,478,606 A 12/1995 Ohkuma et al.
2004/0131957 A1 7/2004 Kubota et al.
2005/0046662 A1 * 3/2005 Okano et al. ..... 347/20
2007/0031756 A1 * 2/2007 Shiba et al. ..... 430/270.1
2008/0024560 A1 1/2008 Ishizuka

FOREIGN PATENT DOCUMENTS

WO 2007/063690 A1 6/2007

* cited by examiner

*Primary Examiner*—John A. McPherson
(74) *Attorney, Agent, or Firm*—Fitzpatrick, Cella, Harper & Scinto

(57) ABSTRACT

A manufacturing method of a liquid discharge head having therein liquid discharge ports and liquid flow passageways communicated with the discharge ports, includes: providing, by depositing, on a substrate, lamination of first and second material layers containing first and second positive type photosensitive resins, respectively, first material layer containing a light absorber absorbing a light in a specific wavelength range to which first positive type photosensitive resin is photosensitive, second positive type photosensitive resin able to be photosensitive to the light in specific wavelength range; exposing second material layer to light in specific wavelength range thereby forming a pattern made of material of second material layer; exposing first material layer to light in specific wavelength range thereby forming a pattern made of first material layer; forming a coating layer covering obtained patterns formed on substrate; forming discharge ports in coating layer; and removing patterns to eventually obtain flow passageways.

9 Claims, 5 Drawing Sheets

METHOD FOR MANUFACTURING LIQUID DISCHARGE HEAD

BACKGROUND OF THE INVENTION

1. Field of the Invention

The present invention relates to a method for manufacturing a liquid discharge head for discharging liquids and more particularly, to a method for forming minute flow passageways at a high efficiency, which are provided in a liquid discharge head employed for an inkjet recording system.

2. Description of the Related Art

An example system that employs a liquid discharge head is an inkjet recording system that discharges ink to recording media to perform recording.

An inkjet recording head, adapted for use in an inkjet recording system, is generally provided with ink discharge ports and ink flow passageways, and energy generating elements, positioned along the ink flow passageways to generate energy necessary for discharging ink through the ink discharge ports, via the ink flow passageways. The ink flow passageways of the inkjet recording head conventionally are formed by using the well known manufacturing methods as set forth below.

According to the manufacturing method disclosed in U.S. Pat. No. 5,478,606, first, a pattern that serves as an ink flow passageway forming die is provided, using a soluble resin, on a substrate whereon energy generating elements have been formed, and then, a coating resin layer, which is used to form the ink flow passageway walls, is deposited on the ink flow passageway die-pattern. Subsequently, photolithography is used to form orifices in the energy generating elements, and then, the ink flow passageway forming-die pattern is melted, to cure the coating resin layer used to define the ink flow passageway walls.

A high processing speed and image quality are demanded for a recent inkjet printer, and accordingly, micromachining is employed for formation of ink flow passageways in an inkjet recording head.

According to the method for forming ink flow passageways using die-patterns, as described in the specification of U.S. Patent Application Publication No. US-2004-0131957, the three-dimensional shape of the minute structure used for ink flow passageways is optimized to increase the ink refilling speed. According to this method, first, a first positive type photosensitive material layer, which is to be exposed to light in a first wavelength range in a bridged state, is deposited on a substrate on which energy generating elements have been formed. Then, the first positive type photosensitive material layer is heated to obtain a bridged positive type photosensitive layer (a lower layer). Following this, an upper layer, composed of a second positive type photosensitive material, which is to be exposed to light in a second wavelength range different from that used for the first wavelength range, is deposited on the lower layer, and as a result, a two-layer structure is obtained. Thereafter, a predetermined portion of the upper layer of the two-layer structure is subjected to radiation of light in the second wavelength range for achieving a developing process. Thus, only the irradiated portion of the upper layer is removed, and a predetermined pattern is formed on the upper layer. Further, a predetermined area of the lower layer, exposed during the pattern formation process employed for the upper layer, is irradiated with light in the first wavelength range to conduct the developing process. In this manner, a predetermined pattern is formed on the lower layer. Through the above-described processing, a pattern can be formed, which can serve as a flow passageway forming die having the optimized three-dimensional shape.

However, when the inkjet recording head manufacturing method described in U.S. Patent Application Publication No. US-2004-0131957 is used, two different wavelengths must be employed for the exposure steps and therefore, the number of processing steps will probably be increased.

SUMMARY OF THE INVENTION

Taking into account the above-described defectives encountered by the conventional art, one objective of the present invention is to provide a method for simplifying the processing steps and manufacturing a liquid discharge head at a high efficiency for which the three-dimensional shape of ink flow passageways is optimized and the discharge efficiency is improved.

According to one aspect of the invention, a method for manufacturing a liquid discharge head provided therein with liquid discharge ports and liquid flow passageways configured to be fluidly communicated with the discharge ports, is provide, which comprises, in combination, the steps of; providing, on a substrate, a lamination of a first material layer and a second material layer arranged on the first material layer, the first material layer containing therein a first positive type photosensitive resin, the second material layer containing therein a second positive type photosensitive resin photosensitive to a light in a specific wavelength range to which the first positive type photosensitive resin is photosensitive, and further at least the first material layer containing a light absorber that absorbs the light in the specific wavelength range to which the first positive type photosensitive resin is photosensitive, exposing the second material layer to the light in the specific wavelength range to which the first positive photosensitive resin is photosensitive, to define a pattern made of the material of the second material layer, exposing the first material layer to the light in the specific wavelength range to define a pattern made of the material of the first material layer, forming a coating layer to cover the patterns defined on the substrate and made of the materials of the overlaid first and second material layers, forming the discharge ports in the coating layer, and removing the patterns, made of the first and second materials of the first and second material layers, to thereby obtain the flow passageways.

In accordance with the manufacturing method of this aspect, the height of the flow passageways can be locally changed without an enormous number of steps being required, and a liquid discharge head can, therefore, be provided that is quickly refilled with ink and that suitably performs high speed printing. A thusly obtained liquid discharge head is able to discharge ink at a high speed permitting the ink to extremely accurately lands to thereby produce ink droplets on a recording medium. Therefore, this liquid discharge head, when employed as an inkjet recording head, is able to provide high quality recording of an image.

Further objects, features and advantages of the present invention will become more apparent from the ensuing description of preferred exemplary embodiments of the present invention with reference to the accompanying drawings.

DESCRIPTION OF THE EMBODIMENTS

One embodiment of the present invention will now be described while referring to the accompanying drawings. In the following description, the same reference numbers are provided for all components having the same functions, and descriptions for duplicate components may not be given.

A liquid discharge head according to the invention can be mounted on a printer or copier having a communication function, a facsimile machine, a word processor equipped with a printer unit, or an industrial recording equipment that incorporates various processing apparatuses to perform multiple functions. When this liquid discharge head is used, recording can be performed on various types of suitable recording media, including paper, yarn, fiber, textiles, leather, metal, plastic, glass, wood and ceramics. Note here that the term "recording", as employed in this specification, does not refer merely to the reproduction, on recording media, of text, characters and figures, but also of images, such as patterns, that have no explicit meaning.

Furthermore, the terms "ink" and "liquid", as used herein, should be broadly interpreted; in this instance, both can be defined as liquids that are applied to surfaces to form, thereon, text or design and pattern images. The term "liquid", however, can also be defined as a solution for treating ink and a surface on which deposited, while processing a recording medium, by coagulating or inhibiting the re-dissolution of the color components of the ink on the recording medium, so as to improve the fixing properties and the recording quality and color development of the ink, and to improve the image durability.

The present invention will now be described by employing an inkjet recording head as an example liquid discharge head.

Figure 1:
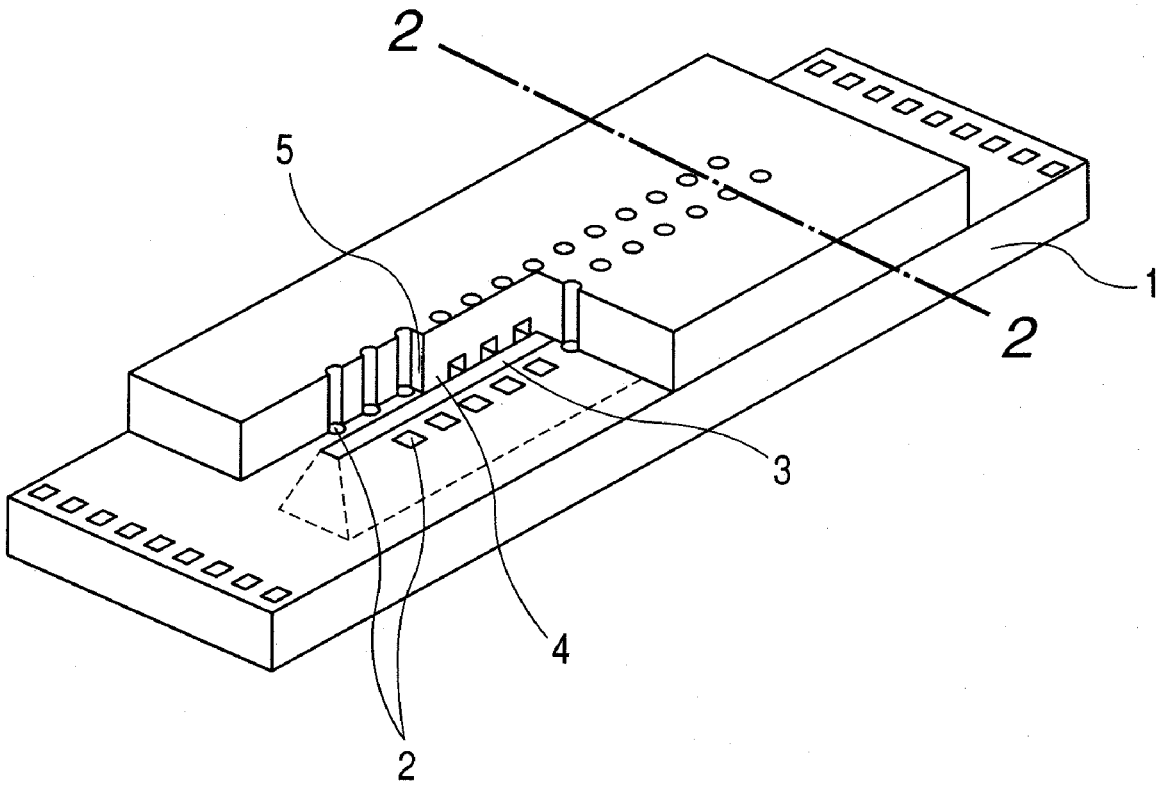
FIG. 1 is a schematic diagram illustrating an inkjet recording head according to one embodiment of the present invention.

FIG. 1 is a schematic diagram illustrating an inkjet recording head according to one embodiment of a liquid discharge head.

The inkjet recording head of this embodiment includes an Si substrate 1, whereon energy generating elements (ink discharge energy generating elements) 2 are arranged at predetermined pitches in two arrays, in order to generate energy that is used to discharge a liquid. A supply port 3 is opened by performing anisotropic etching for the Si substrate 1, between the two arrays of the energy generating elements 2. Further, discharge ports 5, for discharging ink, are formed in the Si substrate 1, at locations opposite the individual energy generating elements 2, as are flow passageways that communicate with the individual discharge pots 5 via the supply port 3. It should be noted that the locations of the discharge ports 5 are not limited to those opposite the energy generating elements 2.

For the inkjet recording head, the face wherein the discharge ports 5 are formed is arranged opposite the recording face of a recording medium. When the inkjet recording head performs recording, energy generated by the energy generating elements 2 is applied to ink fed to the flow passageways via the ink port 3, and ink droplets are discharged from the discharge ports 5 and attached to a recording medium. The energy generating elements 2 can be electro-thermal converting elements (so-called heaters) that generate thermal energy, or piezoelectric elements that generate mechanical energy; however, the energy generating elements that can be used are not limited to these.

An example method for manufacturing the liquid discharge head according to the present invention will now be described while referring to FIGS. 2A to 2J. FIGS. 2A to 2J are schematic cross-sectional views, perpendicular to the substrate 1, taken along line A-A' in FIG. 1, and sequentially illustrate the steps of the method used to manufacture the inkjet recording head in FIG. 1.

Figure 2A:
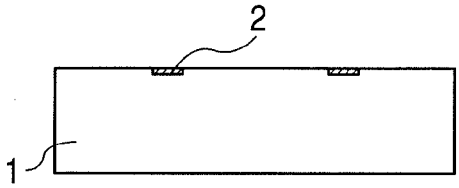
FIGS. 2A, 2B, 2C, 2D, 2E, 2F, 2G, 2H, 2I and 2J are schematic cross-sectional views of the individual steps for an example manufacturing method according to the present invention.

Prepared first, as illustrated in FIG. 2A, is the substrate 1, whereon electro-thermal converting elements are formed as the energy generating converting elements 2. The material used for the substrate 1 can not only be Si, as described above, but can also be glass, a ceramic, a plastic or a metal. Further, generally, various functional layers, such as a protective layer, are deposited in order to improve the life expectancy of the energy generating elements 2, and for this invention, it is perfectly free to deposit such functional layers.

Figure 2B:
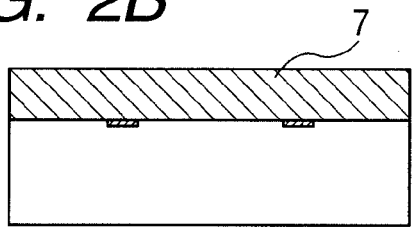

Following this, as illustrated in FIG. 2B, a first positive type photosensitive material layer 7 is formed on the substrate 1. The positive type photosensitive material layer 7 contains a first positive type photosensitive resin and a light absorber that absorbs light in a wavelength range to which the first positive type photosensitive resin is to be exposed.

As the first positive type photosensitive resin, a photodecay type positive resist, such as a Deep-UV ionizing radiation photosensitive type, can be employed. Example photodecay type positive resists are: a high molecular compound of a vinyl ketone type, such as polymethylisopropenyl ketone or polyvinyl ketone; a high molecular compound of a methacrylic type, such as polymethacrylic acid, polymethyl methacrylate, polyethyl methacrylate, poly(n-butyl methacrylate), polyphenyl methacrylate, polymethacrylamide or polymethacrylonitrile; and a high molecular compound of olefin sulfone type, such as polybuden-1-sulfone or polymethylpentene-1-sulfone.

Polymethylisopropenyl ketone is particularly appropriate, from the standpoint that, when used, there is no adverse affect, such as dissolving and merging with a coating layer that is formed later. The material is not limited to this, depending on a coating layer to be formed.

A light absorber can be appropriately selected from among materials that absorb light in a wavelength range to which the first positive type photosensitive resin is to be exposed. For example, an ultraviolet absorber can be employed in a case wherein the first positive type photosensitive resin is to be exposed to light in an ultraviolet wavelength range. However, the light absorber is not limited to this one agent, and the following example ultraviolet absorbers can also be employed: 2,4-di-hydroxybenzophenone, 2-hydroxy-4-methoxybenzophenone, 2-hydroxy-4-n-octoxybenzophenone, 2-hydroxy-4-n-dodecyloxybenzophenone, 2-hydroxy-4-benzoloxybenzophenone, 2,2'-hydroxy-4-methoxybenzophenone, phenyl salicylate, 4-t-butylphenyl salicylate, 2-hydroxy-4-methoxybenzophenone, and 2,4-di-t-butylphenyl-3',5'-di-t-butyl-4-hydroxybenzoate.

2-hydroxy-4-n-octoxybenzophenone is particularly appropriate, from the standpoint that, when used, the photosensitivity of a positive type photosensitive resin is not adversely affected. However, another material can also be employed, depending on a positive type photosensitive resin, so long as the material does not contain a basic compound such as amine, so as not to interfere with the curing of a coating layer that is formed later.

The light absorber content of the first positive type photosensitive material layer 7 is not especially limited, and can be 0.01 to 10 mass % of the material used for the first positive type photosensitive material layer 7. That is, when the light absorber content is equal to or greater than 0.01 mass %, a predetermined function can be exhibited. Further, when the light absorber content is equal to or smaller than 10 mass %, an extreme reduction in the sensitivity of the first positive type photosensitive resin can be prevented, and a desired pattern can be easily formed.

The first positive type photosensitive material layer 7 can be formed by a spin coating method for applying, to the substrate 1, a solution prepared using a solvent in which the first positive type photosensitive resin has been dissolved, or a method for laminating, on the substrate 1, a separately formed first positive type photosensitive material layer 7.

The thickness of the first positive type photosensitive material layer 7 can, for example, be 10 to 15 μm.

Figure 2C:
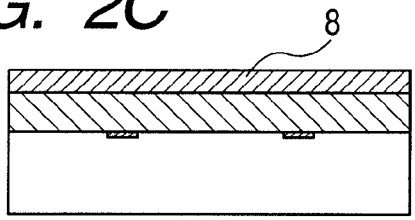

Next, as shown in FIG. 2C, a second positive type photosensitive material layer 8 is formed on the first positive type photosensitive material layer 7. This second positive type photosensitive material layer 8 contains a second positive type photosensitive resin.

So long as the second positive type photosensitive resin is a material that is to be exposed to light in the same wavelength range as is the first positive type photosensitive resin, either the composition used for the first positive type photosensitive resin can also be used for as the second positive type photosensitive resin, or only a similar basic composition may be employed. It is preferable that the wavelength ranges in which the first and second positive type photosensitive resins are to be exposed nearly overlap, and even more preferably, the compositions of the first and the second positive type photosensitive resins be identical, because in a succeeding process, it is easier to expose the first and the second positive type photosensitive material layers using the same wavelength.

Since, as will be described later, the second positive type photosensitive material layer 8 is to be exposed before the first positive type photosensitive material layer 7, the exposure process for the second positive type photosensitive material layer 8 should be performed more efficiently. Therefore, it is preferable that the second positive type photosensitive material layer 8 should not contain a light absorber for absorbing light in a wavelength range to which the first positive type photosensitive material layer 7 is to be exposed. Thus, even when the second positive type photosensitive material layer 8 contains a light absorber, the light absorber content should be equal to or lower than that of the first positive type photosensitive material layer 7, and should actually be lower. Therefore, the light absorber content of the second positive type photosensitive material layer 8 can be defined, for example, as not exceeding the 10 mass % of the material used for the first positive type photosensitive material layer 8.

The second positive type photosensitive material layer 8 can be formed using the same method as that employed for the first positive type photosensitive material layer 7.

The thickness of the second positive type photosensitive material layer 8 can, for example, be 5 to 10 μm. And in this embodiment, appropriately, the first positive type photosensitive material layer 7 is thicker than the second positive type photosensitive material layer 8. One of the reasons for this is that near the energy generating elements 2, larger flow passageways can be formed so that ink can be efficiently introduced to the discharge ports 5. Another reason is manufacturing related, and will be described later.

Figure 2D:
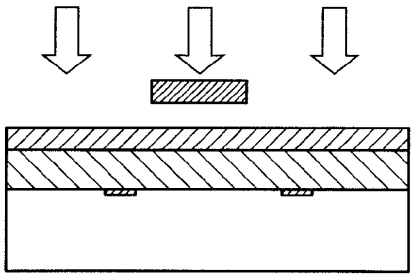

Sequentially, as shown in FIG. 2D, a mask is used to expose and irradiate with light one part of the second positive type photosensitive material layer 8. The wavelength of the light used can be one selected from the wavelength range of the light used to irradiate the first positive type photosensitive material layer 7 (i.e., the wavelength range of the light to which the second positive type photosensitive material layer 8 is exposed).

At this step, since light is absorbed by the second positive type photosensitive material layer 8, the intensity of the light available for irradiating the second positive type photosensitive material layer 8 is attenuated, in the direction corresponding to that from the obverse face to the surface of the substrate 1. Furthermore, light exposure of the first positive type photosensitive material layer 7 can be proportionally decreased by the light absorbent capability exhibited by the light absorber in the first positive type photosensitive material layer 7. And thus, when as previously described, the thickness of the first positive type photosensitive material layer 7 is greater than that of the second positive type photosensitive material layer 8, the effect produced by the light exposure of the first positive type photosensitive material layer 7 can be reduced to as near insignificance as feasible. The thickness of the first positive type photosensitive material layer 7 is, preferably, two times greater than that of the second positive type photosensitive material layer 8.

Therefore, a light exposure intensity, relative to the second positive type photosensitive material layer 8, can be properly selected that ensures the second positive type photosensitive material layer 8 will be satisfactorily exposed and that the first positive type photosensitive material layer 7 will not be adversely affected. To accomplish the foregoing, for example, an intensity of 2000 to 10000 mJ/cm$^2$ may be employed.

Figure 2E:
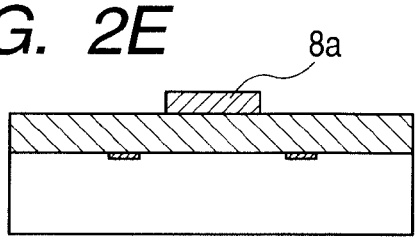

When, as shown in FIG. 2E, the second positive type photosensitive material layer 8 is developed, a pattern 8*a* for the second positive type photosensitive material layer 8 can be obtained.

Figure 2F:
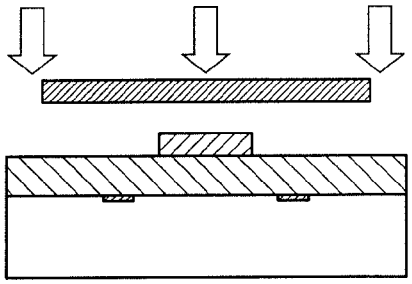

Following this, as shown in FIG. 2F, a mask is used to expose and irradiate with light one part of the first positive type photosensitive material layer 7. The wavelength of the light used is one available in the same range as that of the wavelength used when the first positive type photosensitive material layer 7 was exposed, and it is preferable that the wavelength used to expose the second positive type photosensitive material layer 8 be employed.

At this step, since a light absorber is contained in the first positive type photosensitive material layer 7 that is irradiated with light, the exposure intensity should generally be greater than that previously provided when the second positive type photosensitive material layer 8 was exposed. Therefore, the intensity of the light used to expose the first positive type photosensitive material layer 7 should be greater than the intensity of light used to expose the second positive type photosensitive material layer 8. For example, the intensity of the selected light can range from 10000 to 30000 mJ/cm$^2$.

Figure 2G:
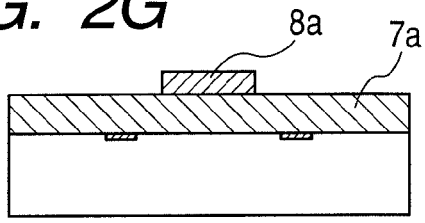

As shown in FIG. 2G, when the first positive type photosensitive material layer 7 is developed, a pattern 7*a* is obtained. This pattern 7*a* and the pattern 8*a*, the two of which have been obtained in like manners for the first and the second positive type photosensitive material layers 7 and 8, are intended to be employed for flow passageways.

Figure 2H:
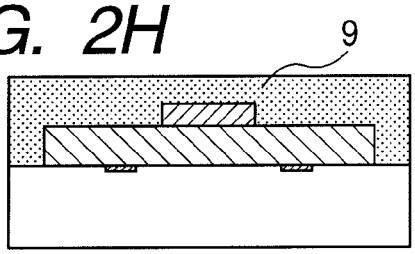

Then, as shown in FIG. 2H, a coating layer 9 is deposited to cover the patterns 7*a* and 8*a*, of the first and second positive type photosensitive material layers 7 and 8 that are overlaid on the substrate 1. The coating layer 9 serves as a flow passageway formation member 4, for forming flow passageway walls. The material of the coating layer 9 can, for example, be either an epoxy resin or a polyimide resin, and the coating layer 9 can be formed by applying a coating layer formation liquid. An example coating layer formation liquid may be a solution obtained by dissolving, in a solvent, a coating layer formation material containing an epoxy resin and a cationic polymerization initiator.

Figure 2I:
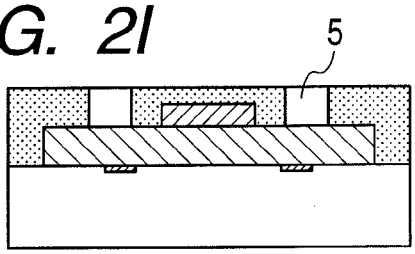
Figure 2J:
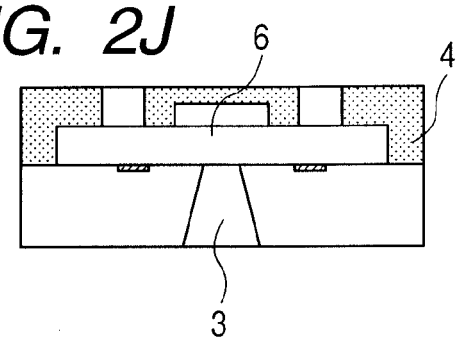

Sequentially, then, as shown in FIG. 2I, the discharge ports 5 are formed. Thereafter, the ink supply port 3 is formed, and the patterns 7*a* and 8*a*, for the first and second positive type photosensitive material layers 7 and 8, are removed, so that, as shown in FIG. 2J, an inkjet recording head is obtained wherein flow passageways 6 are formed using the flow passageway formation member 4. When, for example, soluble materials are employed for the first and second positive type photosensitive material layers 7 and 8, removal of the patterns 7*a* and 8*a* can be accomplished by dissolving them in a suitable fluid.

Figure 3A:
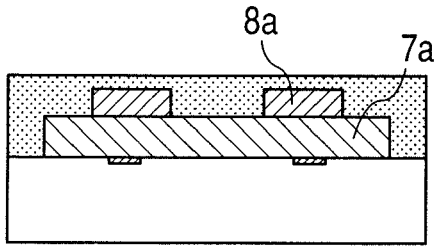
FIGS. 3A and 3B are schematic cross-sectional views of part of the steps for the example manufacturing method of the present invention.
Figure 3B:
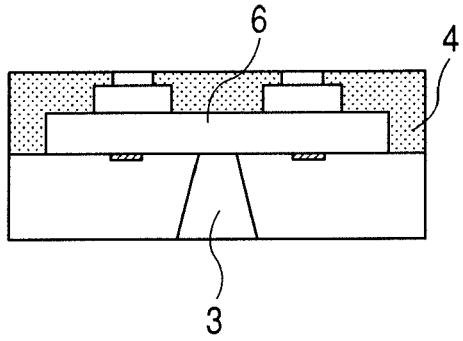

Flow passageways 6 having desired shapes can be formed by selecting which mask patterns are to be used at the steps in FIGS. 2D and 2F. For example, instead of the patterns shown in FIG. 2G, patterns 7*a* and 8*a* illustrated in FIG. 3A can be formed for the first and second positive type photosensitive material layers 7 and 8, and thereafter, flow passageways 6 having shapes illustrated in FIG. 3B can be provided.

Another example method for manufacturing a liquid discharge head according to the present invention will now be described.

Figure 4A:
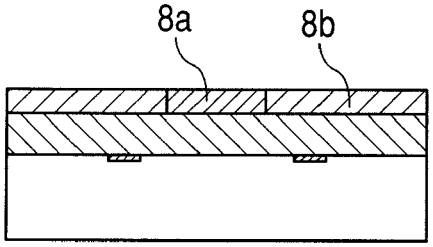
FIGS. 4A, 4B, 4C and 4D are schematic cross-sectional views of part of the steps for the example manufacturing method of the present invention.
Figure 4C:
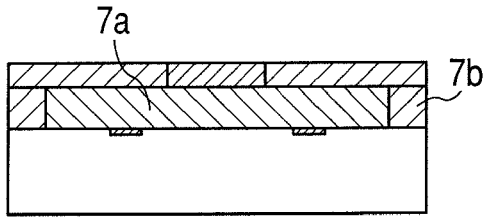
Figure 4B:
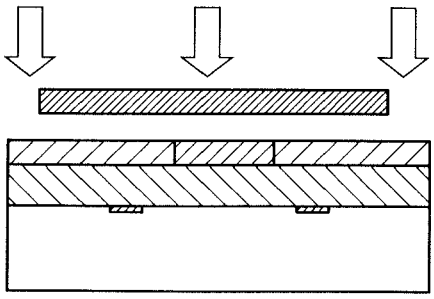
Figure 4D:
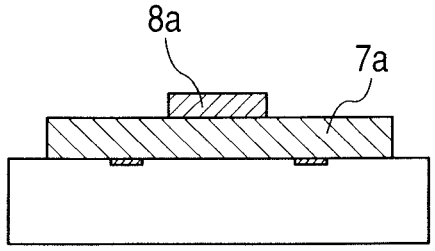

First, the steps illustrated in FIGS. 2A to 2D are performed, and then, as illustrated in FIG. 4A, a latent image is formed that is composed of an exposed portion 8*b* of the second positive type photosensitive material layer 8 and an unexposed portion (a portion that becomes a pattern 8*a* for the second positive type photosensitive material layer 8). Following this, as illustrated in FIG. 4B, the first positive type photosensitive material layer 7 is exposed through the exposed portion 8*b* of the second positive type photosensitive material layer 8. As a result of this exposure, as illustrated in FIG. 4C, a latent image is formed composed of an exposed portion 7*b* of the first positive type photosensitive material layer 7 and an unexposed portion thereof (a portion that becomes a pattern 7*a* for the first positive type photosensitive material layer). Then, the first and second positive type photosensitive material layers 7 and 8 are collectively developed, and the patterns 7*a* and 8*a* are obtained for the first and second positive type photosensitive material layers 7 and 8, as illustrated in FIG. 4D. Thereafter, the steps illustrated in FIGS. 2H to 2J are performed, and an inkjet recording head is obtained.

An additional example manufacturing method will now be described. In this example, a three-layer flow passageway pattern is to be formed.

Figure 8A:
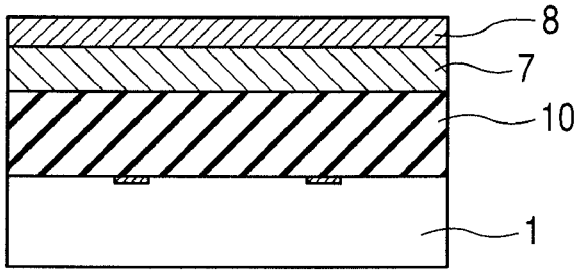
FIGS. 8A and 8B are schematic cross-sectional views of part of the steps for another example manufacturing method of the present invention.
Figure 8B:
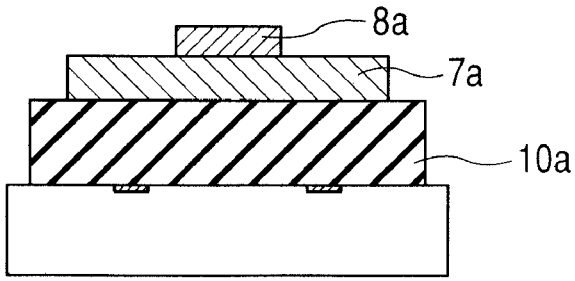

During the processing performed to overlay multiple positive type photosensitive material layers on the substrate 1, as shown in FIG. 8A, a third overlying material layer 10 is formed before the first material layer 7. Subsequently, thereafter, the second material overlying layer 8 is overlaid on the first material layer 7. In this instance, the individual overlying layers each contain a positive type photosensitive resin, and the ultraviolet absorber content of the first material layer 7 is greater (by weight ratio) than that of the second material layer 8, while the content of the third material layer 10 is greater than that of the first material layer 7. With this arrangement, sensitivity is reduced at each lower layer, and therefore, during the processing performed to expose individual layers, the affect of an exposed layer relative to a lower layer can be reduced and a satisfactory pattern obtained. When patterning is performed for the laminated layers in FIG. 8A, and the resultant structure is as illustrated in FIG. 8B, compared with a lamination formed using only two layers, a more complicated shape can be obtained. It should be noted that patterns 7*a*, 8*a* and 10*a* are those formed from of the first, second and third material layers.

These steps can be performed by using the same method as that described for FIG. 2H.

EXAMPLE

The present invention will be more specifically described by employing the following example.

Figure 5:
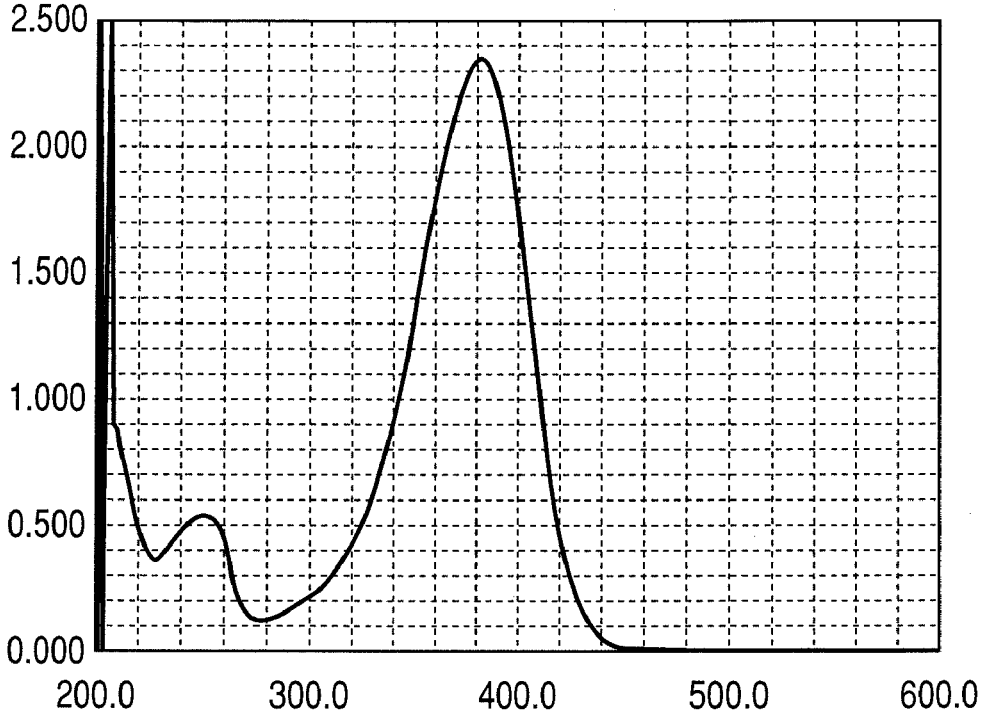
FIG. 5 is a graph illustrating the light absorption characteristic of an ultraviolet absorber employed in an example for the present invention.

As research, an evaluation was performed to determine what the reduction in sensitivity would be in a case wherein an ultraviolet absorber was added to a positive type photosensitive resin. Polymethylisopropenyl ketone (product name: ODUR 1010A, produced by Tokyo Ohka Kogyo Co., Ltd.) was employed as a positive type photosensitive resin, and an ultraviolet absorber was employed that exhibits the light absorption characteristic illustrated in FIG. 5. In FIG. 5, the horizontal axis represents a wavelength (nm) and the vertical axis represents a relative intensity (an arbitrary unit).

First, a 6 inch wide Si wafer was prepared as a substrate 1, and a 1.0 μm $SiO_2$ layer was deposited using thermal oxidization. Then, a layer composed of polymethylisopropenyl ketone or a layer composed of polymethylisopropenyl ketone, to which an ultraviolet absorber had been added, was deposited using spin coating, and the resultant substrate was baked for six minutes at 120° C. As a result, a 14 μm thick photosensitive material layer was obtained. Following this, the photosensitive material layer was arbitrarily exposed using UX3000 (product name), produced by Ushio Inc., and a development process using MIBK and rinsing using IPA were performed. Thereafter, an appropriate pattern was obtained.

Figure 6:
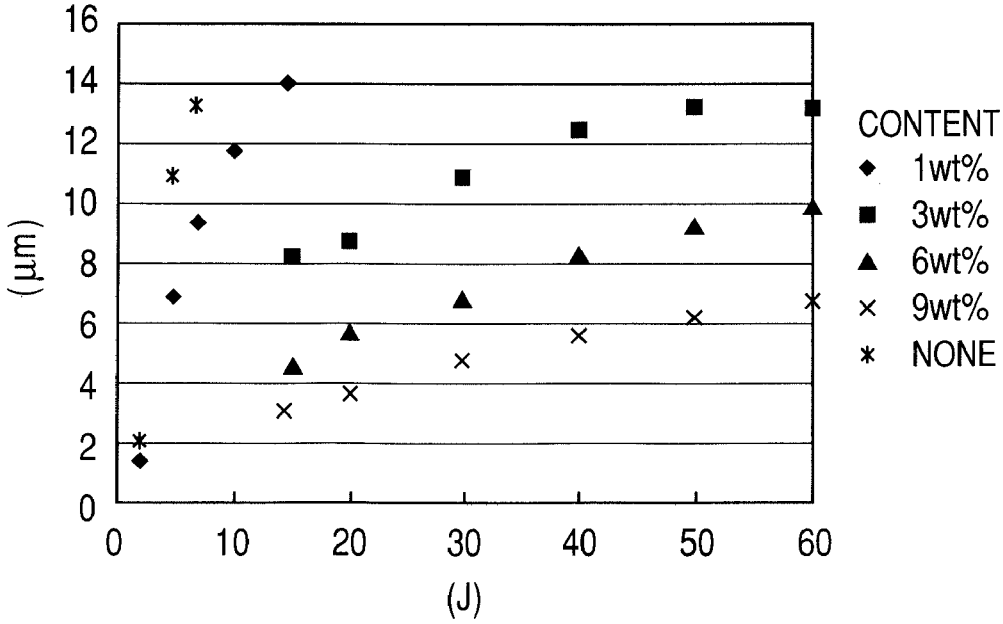
FIG. 6 is a graph illustrating changes in the light exposure intensity and in the measurable development for a photosensitive resin when the content of the ultraviolet absorber, used in the example, was changed relative to the photosensitive resin.

When a correlation between the exposure intensity and the measurable development (the degree of development) was examined, the results shown in FIG. 6 were obtained. The data provided using the graph represents the weight of the contained ultraviolet absorber relative to the weight of the polymethylisopropenyl ketone. When the ultraviolet absorber content is increased, the measurable development (the amount removed by a solvent, and an amount corresponding to that which was changed to positive by light) is reduced. As a result, it was confirmed that when ultraviolet absorber is added, the sensitivity of the positive type photosensitive resin is reduced. And further, that when the exposure intensity is small (equal to or smaller than 10 J), only ultraviolet absorber need be added to reduce the measurable development.

Example 1

According to this example, the following manufacturing method was employed to fabricate an inkjet recording head having two ink flow passageways.

First, as illustrated in FIG. 2A, electro-thermal converting elements were arranged, as energy generating elements 2, on an Si wafer substrate 1 having a crystal axis (100) along which an ink supply port formation mask (not shown) was prepared. Further, a protective layer and a cavitation preventive layer (not shown) were deposited. It should be noted that control signal input electrodes are connected to the electro-thermal converting elements to control the operation of these elements (not shown).

Sequentially, as illustrated in FIG. 2B, a polymethylisopropenyl ketone layer, to which a 3 mass % of 2-hydroxy-4-methoxybenzophenone (KEMISORB11, produced by Chemipro Kasei Kaisha, Ltd.) was added, was deposited on the substrate 1. Then, the structure was baked for six minutes at 120° C. and a first photosensitive material layer 7 of 10 μm thick was obtained. Furthermore, as illustrated in FIG. 2C, a polymethylisopropenyl ketone layer was deposited on the first photosensitive material layer 7 using spin coating, and the resultant substrate 1 was baked for six minutes at 120° C. Thus, a second, 10 μm thick photosensitive material layer 8 was obtained.

Following this, as illustrated in FIG. 2D, the second photosensitive material layer 8 was exposed to light having an intensity of 5300 mJ/cm$^2$ using UX3000 (product name) produced by Ushio Inc., and was developed. As a result, a second photosensitive material layer pattern 8*a*, illustrated in FIG. 2E, was formed. Further, this structure was exposed to light having an intensity of 33380 mJ/cm$^2$ and was developed, and as illustrated in FIG. 2G, a pattern 7*a* was obtained for the first photosensitive material layer 7.

Sequentially, as illustrated in FIG. 2H, a coating liquid obtained by dissolving a resin composition I, shown in Table 1, in an appropriate solvent was applied to the substrate 1 to form a coating layer 9.

(Resin Composition I)

Alicyclic epoxy resin (EHPE3150, produced by Daicel Chemical Industries, Ltd.)

Cationic polymerization imitator of a sulfonium salt type (SP-172, produced by Adeka Corporation)

Silane coupling agent (A-187, produced by Dow Corning Toray Co., Ltd.)

Then, as illustrated in FIG. 2I, discharge ports 5 were formed in the coating layer 9 using photolithography.

Next, an ink supply port 3 was formed by performing anisotropic etching of the substrate 1, and thereafter, the protective layer and the patterns 7*a* and 8*a* of the first and second photosensitive material layers 7 and 8 were removed from above the ink support port 3. Further, the substrate 1 was heated for one hour at 200° C. in order to completely cure the epoxy resin of the coating layer 9, and finally, an inkjet recording head was obtained that included flow passageways 6 having the structure shown in FIG. 6J.

Comparison Example

Figure 7:
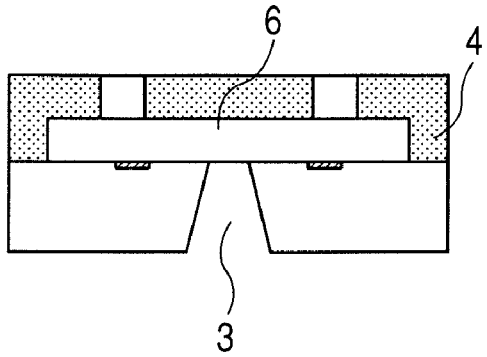
FIG. 7 is a schematic cross-sectional view of an inkjet recording head manufactured as a comparison example.

The processing was performed in the same manner as in Example 1, except that only one photosensitive polymethylisopropenyl ketone layer was formed. As a result, an inkjet recording head was obtained that included flow passageways 6 having the structure illustrated in FIG. 7.

(Evaluation)

The inkjet recording heads thus obtained were mounted on printers, and the ink discharge and recording functions of the heads were examined. Both of the inkjet recording heads satisfactorily enabled image recording; however, when after ink was discharged ink refill speeds were measured, only 21 μsec was required for the inkjet recording head produced in accordance with the process in example 1, while 48 μm was required for the inkjet recording head produced in accordance with the process for the comparison example. That is, according to the inkjet recording head having the structure in FIG. 2J, ink refill can be accomplished at an extremely high speed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-140303, filed May 28, 2007, which is hereby incorporated by reference herein in its entirety.

What is claimed is:

1. A method for manufacturing a liquid discharge head provided therein with liquid discharge ports and liquid flow passageways configured to be communicated with the discharge ports, comprising, in combination, the steps of:

providing, on a substrate, a lamination of a first material layer and a second material layer arranged on the first material layer, the first material layer containing therein a first positive type photosensitive resin, the second material layer containing therein a second positive type photosensitive resin photosensitive to a light in a specific wavelength range to which the first positive type photosensitive resin is photosensitive, and further at least the first material layer containing therein a light absorber that absorbs the light in the specific wavelength range to which the first positive type photosensitive resin is photosensitive;

exposing the second material layer to the light in the specific wavelength range to which the first positive photosensitive resin is photosensitive, to define a pattern made of the material of the second material layer;

exposing the first material layer to the light in the specific wavelength range to define a pattern made of the material of the first material layer;

forming a coating layer configured to cover the patterns defined on the substrate and made of the materials of the overlaid first and second material layers;

forming the discharge ports in the coating layer; and removing the patterns made of the materials of the first and second material layers, to thereby obtain the flow passageways, wherein the first material layer has a thickness thereof that is greater than that of the second material layer.

2. The manufacturing method according to claim 1, wherein a light intensity of the light to which the first material layer is exposed is greater than a light intensity of the light to which the second material layer is exposed.

3. The manufacturing method according to claim 1, wherein both the first and second positive type photosensitive resins are polymethylisopropenyl ketone.

4. The manufacturing method according to claim 1, wherein the second material layer contains none of a light absorber that absorbs the light in the wavelength range to which the first positive type photosensitive resin is photosensitive.

5. The manufacturing method according to claim 1, wherein the second material layer contains the light absorber, a ratio of containing of the light absorber in the first material layer is greater than that of the light absorber in the second material layer.

6. A method for manufacturing a liquid discharge head provided therein with liquid discharge ports and liquid flow passageways configured to be communicated with the discharge ports, comprising, in combination, the steps of:

providing, on a substrate, a lamination of a first material layer and a second material layer arranged on the first material layer, the first material layer containing therein a first positive type photosensitive resin, the second material layer containing therein a second positive type photosensitive resin photosensitive to a light in a specific wavelength range to which the first positive type photosensitive resin is photosensitive, and further at least the first material layer containing therein a light absorber that absorbs the light in the specific wavelength range to which the first positive type photosensitive resin is photosensitive;

exposing the second material layer to the light in the specific wavelength range to which the first positive photosensitive resin is photosensitive, to define a pattern made of the material of the second material layer;

exposing the first material layer to the light in the specific wavelength range to define a pattern made of the material of the first material layer;

forming a coating layer configured to cover the patterns defined on the substrate and made of the materials of the overlaid first and second material layers;

forming the discharge ports in the coating layer; and removing the patterns made of the materials of the first and second material layers, to thereby obtain the flow passageways, wherein the second material layer contains the light absorber, a ratio of containing of the light absorber in the first material layer is greater than that of the light absorber in the second material layer.

7. The manufacturing method according to claim 6, wherein a light intensity of the light to which the first material layer is exposed is greater than a light intensity of the light to which the second material layer is exposed.

8. The manufacturing method according to claim 6, wherein the first material layer has a thickness thereof that is greater than that of the second material layer.

9. The manufacturing method according to claim 6, wherein both the first and second positive type photosensitive resins are polymethylisopropenyl ketone.

* * * * *